US008556243B2

(12) United States Patent
Chen

(10) Patent No.: US 8,556,243 B2
(45) Date of Patent: Oct. 15, 2013

(54) BAR CLAMP WITH DEVICE FOR FASTENING SLIDE BAR OF ANOTHER BAR CLAMP

(75) Inventor: Wei-Li Chen, Taichung (TW)

(73) Assignee: Lai Lien Steel Co., Ltd., Taichung (TW)

( * ) Notice: Subject to any disclaimer, the term of this patent is extended or adjusted under 35 U.S.C. 154(b) by 143 days.

(21) Appl. No.: 13/306,939

(22) Filed: Nov. 29, 2011

(65) Prior Publication Data

US 2013/0134642 A1 May 30, 2013

(51) Int. Cl.
*B25B 5/16* (2006.01)

(52) U.S. Cl.
USPC ..... 269/6; 269/3; 269/225; 269/231

(58) Field of Classification Search
USPC ..... 269/3, 6, 95, 229, 231, 143, 249; 29/270, 255, 278
See application file for complete search history.

(56) References Cited

U.S. PATENT DOCUMENTS

| | | | | |
|---|---|---|---|---|
| 5,167,405 | A * | 12/1992 | Cayley, Jr. | 269/309 |
| 5,671,915 | A * | 9/1997 | Williams | 269/231 |
| 8,430,383 | B2 * | 4/2013 | Strauss | 269/5 |
| 2009/0206534 | A1 * | 8/2009 | McCracken | 269/6 |
| 2013/0134642 | A1 * | 5/2013 | Chen | 269/6 |

* cited by examiner

*Primary Examiner* — Lee D Wilson

(57) ABSTRACT

A bar clamp is provided with a slide bar; a movable housing on the slide bar and including a movable jaw carrier including a first jaw at one end, a handgrip, and a trigger handle; a housing member releasably mounted on the slide bar and including a fixed jaw carrier and a second jaw; and a cam type fastening device on fixed jaw carrier. In an inoperative position thin portions of cam rings are locked allow a slide bar of another bar clamp to freely pass through the fastening device. A clockwise pivotal movement of a lever locks thick portions of the cam rings to fasten the slide bar of another bar clamp.

2 Claims, 10 Drawing Sheets

8-8

BAR CLAMP WITH DEVICE FOR FASTENING SLIDE BAR OF ANOTHER BAR CLAMP

BACKGROUND OF THE INVENTION

1. Field of the Invention

The invention relates to bar clamps and more particularly to a bar clamp having a fastening device for temporarily fastening the slide bar of another bar clamp.

2. Description of Related Art

Clamps of various types have been available for a long time and are used in many applications where it is necessary to hold two or more objects together temporarily. A common problem associated with the use of clamps is that the objects may not be clamped firmly by the jaws. Further, it may sometimes be necessary to use a fixture or other temporary holding device to retain the objects in position so that the desired clamp can be used. However, this is cumbersome and also time consuming.

What needed is a clamp (e.g., bar clamp) which is convenient and efficient to use in clamping two or more objects together. The invention discussed below aims to meet the need.

SUMMARY OF THE INVENTION

It is therefore one object of the invention to provide a bar clamp comprising a slide bar; a movable housing slidably mounted on the slide bar and comprising a movable jaw carrier including a first jaw at one end, a handgrip extending in a direction opposing the movable jaw carrier, and a trigger handle disposed in front of the handgrip, one end of the trigger handle being pivotably disposed in the housing; a housing member releasably mounted on a forward end of the slide bar and comprising a fixed jaw carrier and a second jaw at one end of the fixed jaw carrier; and a fastening device comprising a through hole formed through the fixed jaw carrier; a cylindrical urging assembly disposed through the through hole and including a first member having a lengthwise first groove, and a second member having a lengthwise second groove, the second member being a mirror of the first member and spaced from the first member by a gap; and a cam assembly including two arc members wherein one arc member is formed besides one end of the through hole and the other arc member is formed between the other end of the through hole, and a cam member including two spaced, opposite cam rings each having a first portion and a second portion opposing the first portion and larger than the first portion, and a lever formed with the cam rings, wherein each cam ring has an eccentric outer surface, the cam member is put on projecting portions of the first and second members with the cam rings being pivotably contacted the arc members, in an inoperative position the first portions of the cam rings are lockingly engaged with the arc members to allow a slide bar of another bar clamp to freely pass through the first and second grooves, and a clockwise pivotal movement of the lever lockingly engages the second portions of the cam rings with the arc members by drawing the first member toward the second member to fasten the slide bar of another bar clamp.

The above and other objects, features and advantages of the invention will become apparent from the following detailed description taken with the accompanying drawings.

DETAILED DESCRIPTION OF THE INVENTION

Figure 1:
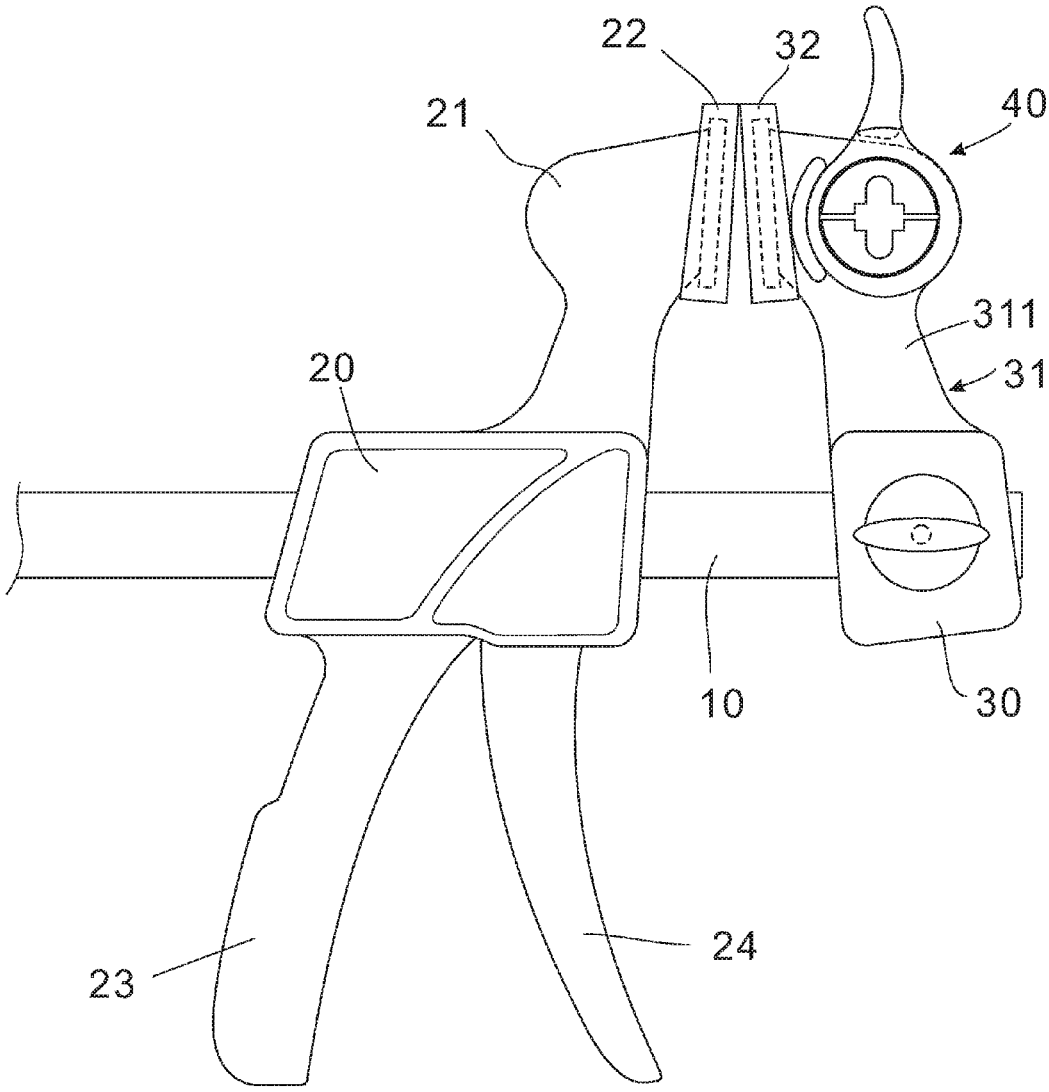
FIG. 1 is a side elevation of a bar clamp according to a first preferred embodiment of the invention in an inoperative position.
Figure 2:
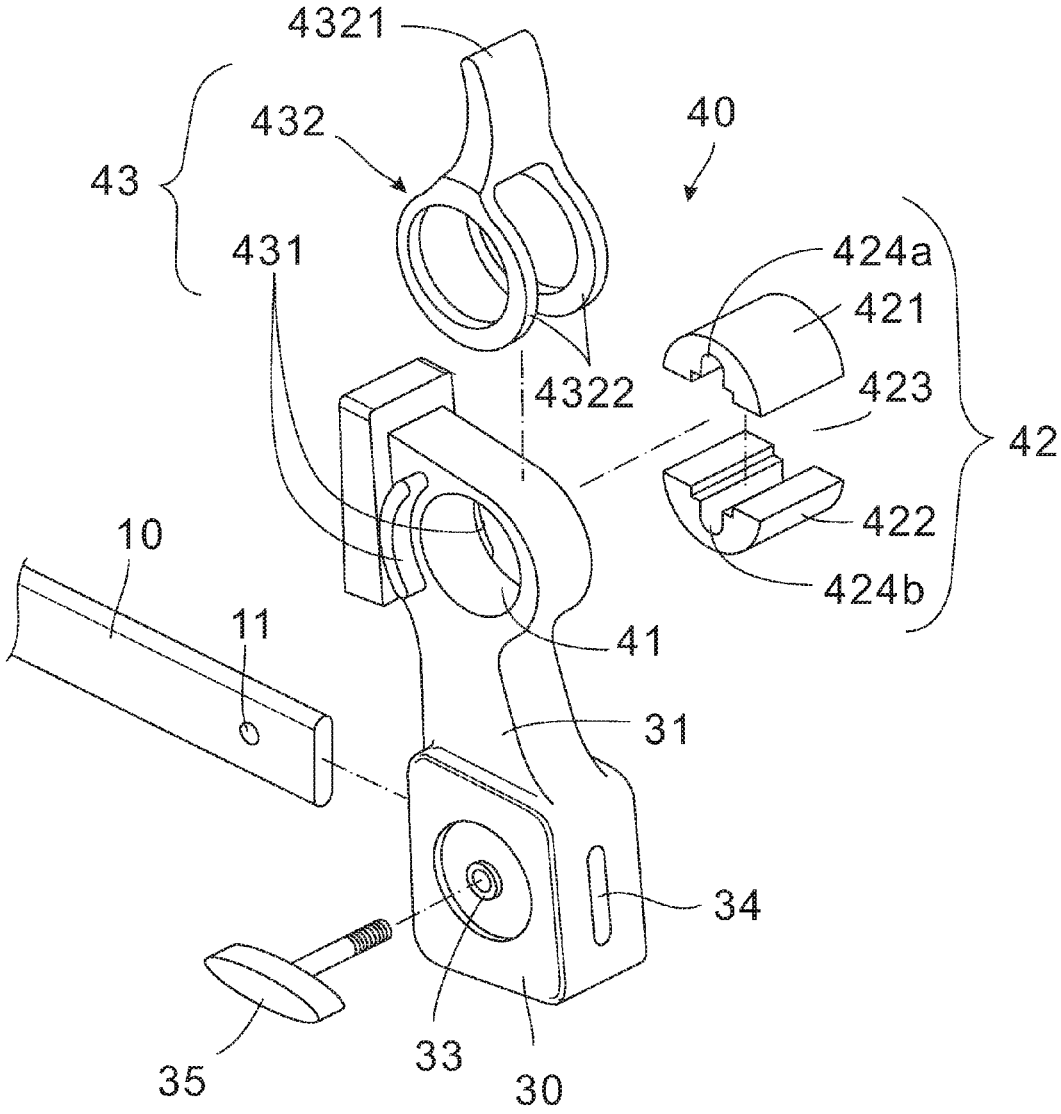
FIG. 2 is an exploded view of the bar clamp except the housing and its components.

Referring to FIGS. 1 to 6, a bar clamp in accordance with a first preferred embodiment of the invention comprises the following components as discussed in detail below.

A slide bar 10 is configured as a flat bar and has a forward through hole 11. A movable housing 20 is slidably mounted on the slide bar 10 and comprises a movable jaw carrier 21 including a first jaw 22 at one end, a handgrip 23 extending in a direction opposing the movable jaw carrier 21, and a trigger handle 24 extending in the direction opposing the movable jaw carrier 21 and being forward of the handgrip 23, one end of the trigger handle 24 being pivotably disposed in the housing 20.

A housing member 30 is disposed on the slide bar 10 and comprises a transverse threaded hole 33, a longitudinal channel 34 shaped to complementarily receive the slide bar 10 and intersecting the threaded hole 33, a threaded fastener 35 driven through the threaded hole 33 and the through hole 11 to fasten the housing member 30 and the slide bar 10 together, an extending fixed jaw carrier 31, and a second jaw 32 at one end of the fixed jaw carrier 31 facing the first jaw 22.

A fastening device 40 comprises a through hole 41 formed through the fixed jaw carrier 31 adjacent the second jaw 32; a cylindrical urging assembly 42 disposed through the through hole 41 and including a first member 421 having a lengthwise groove 424*a*, a second member 422 having a lengthwise groove 424*b*, the second member 422 being a mirror of the first member 421, and a gap 423 defined between the first member 421 and the second member 422; and a cam assembly 43 including two arc members 431 wherein one arc member 431 is formed between the second jaw 32 and one end of the through hole 41 and the other arc member 431 is formed between the second jaw 32 and the other end of the through hole 41, and a cam member 432 including two spaced, opposite cam rings 4322 and a lever 4321 formed with and interconnecting the cam rings 4322.

The width of the cam ring 4322 is not uniform. That is, the cam ring 4322 has a wide portion, an opposite narrow portion, and two intermediate portions each progressively formed between the wide portion and the narrow portion. A gap defined between the cam rings 4322 is substantially equal to the length of the through hole 41 so that the cam member 432 can be put on the projecting portions of the urging assembly 42 to have its cam rings 4322 rotatably contacting the arc members 431.

Figure 3:
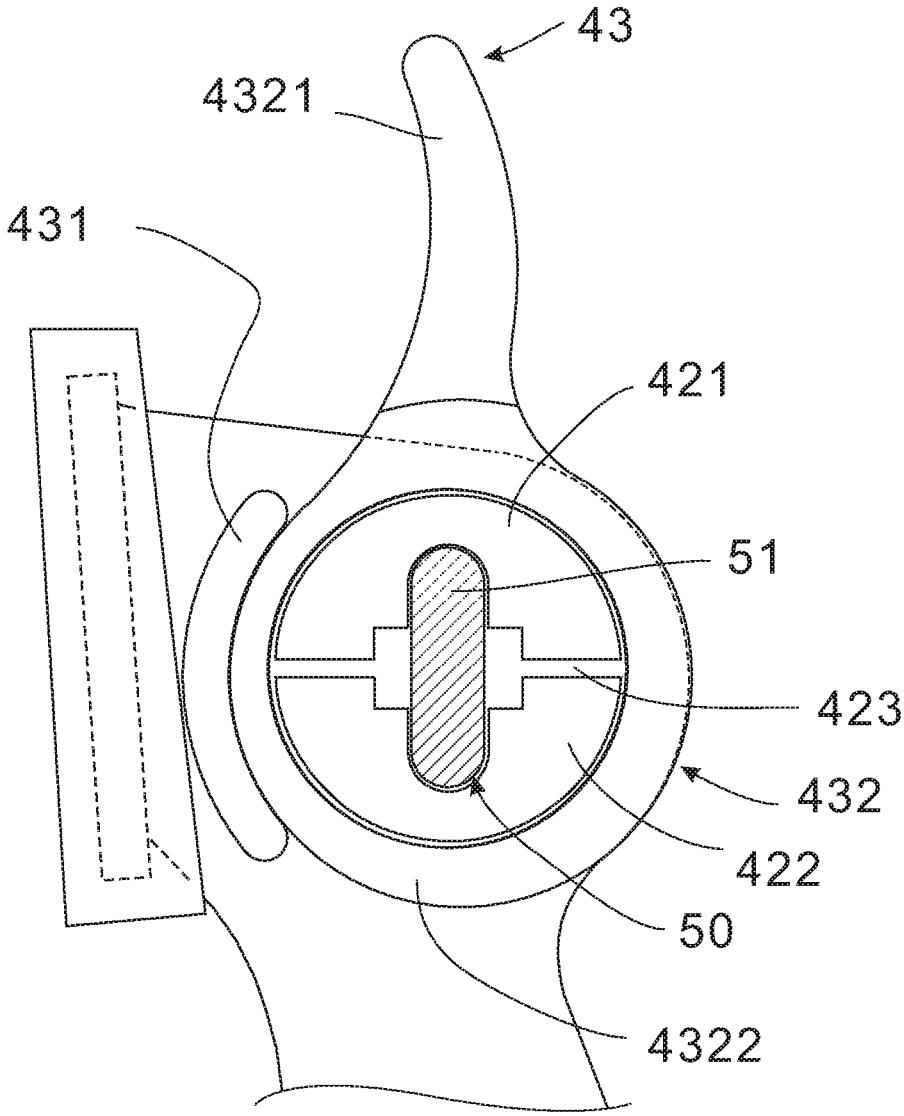
FIG. 3 is an enlarged view of the right top portion of FIG. 1 with a slide bar of another bar clamp loosely disposed through the urging assembly.
Figure 5:
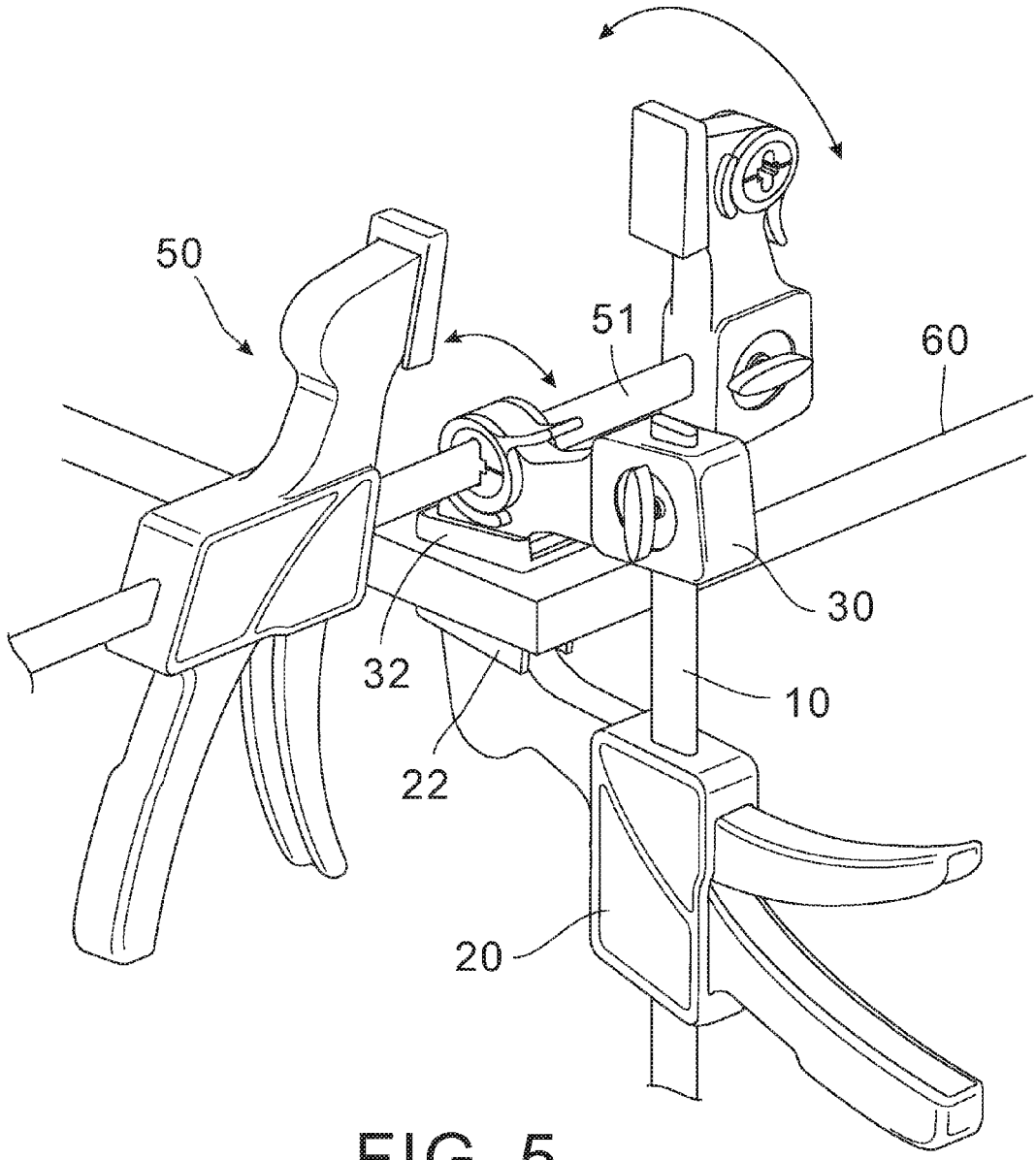
FIG. 5 is a perspective view showing two bar clamps being mounted on a workbench ready for work.
Figure 6:
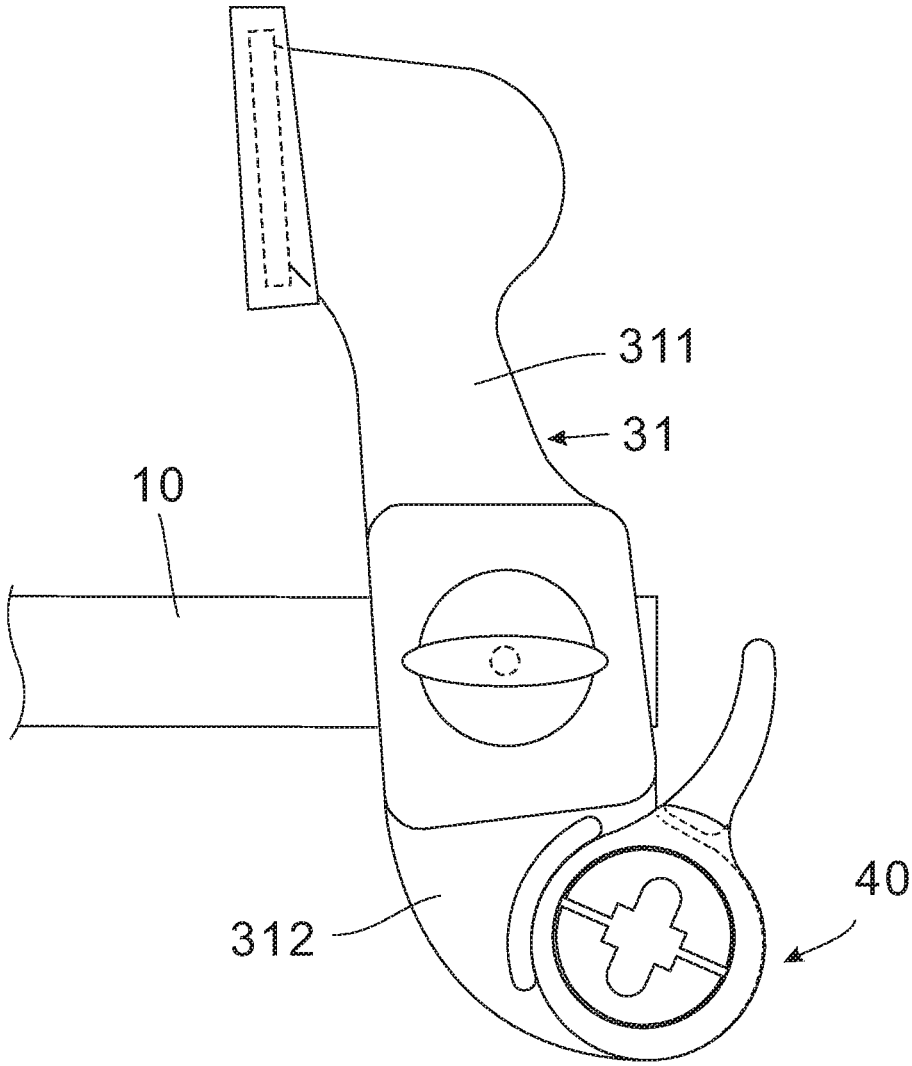
FIG. 6 is an enlarged view of the right side portion of FIG. 1 but showing another configuration of the fastening device which is disposed on an end of an extension opposite to the fixed jaw carrier.
Figure 7:
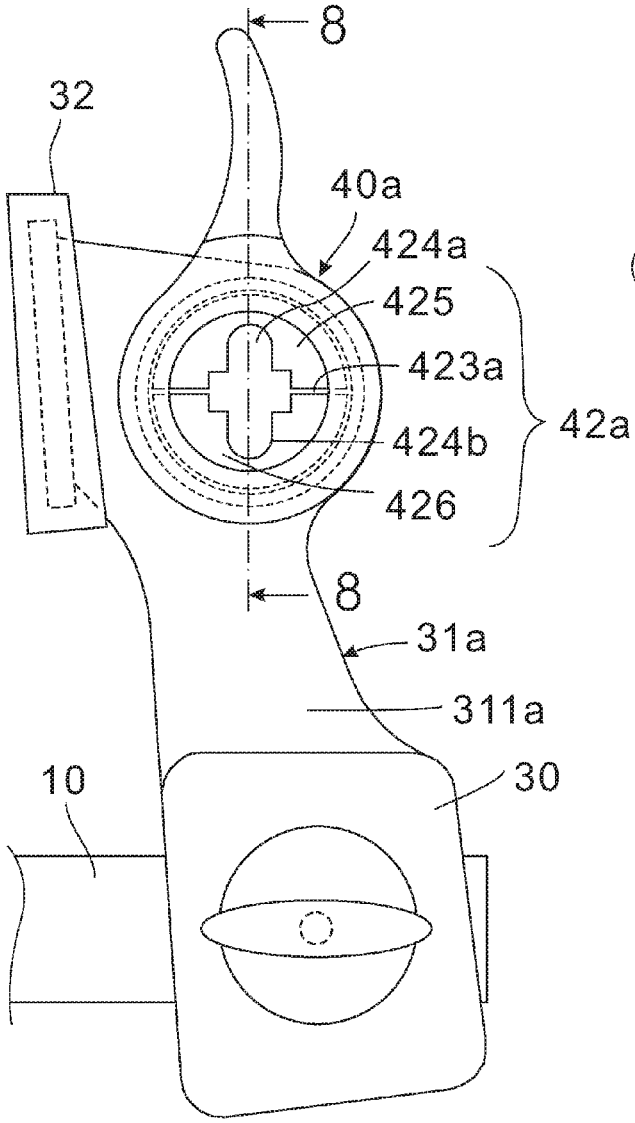
FIG. 7 is a side elevation of a right side portion of a bar clamp according to a second preferred embodiment of the invention in an inoperative position.
Figure 8:
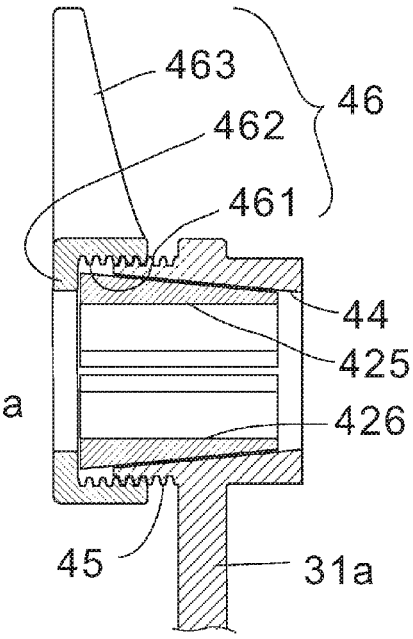
FIG. 8 is a sectional view taken along line 8-8 of FIG. 7.

In an inoperative position (see FIGS. 2 and 3), the lever 4321 is substantially aligned with the fixed jaw carrier 311 and the narrow portions of the cam rings 4322 are lockingly engaged with the arc members 431. As shown in FIGS. 3 and 5, one bar clamp is secured to a workbench 60 and another bar clamp 50 having its slide bar 51 passing through the fastening device 40 of one bar clamp. That is, the loose slide bar 51 of another bar clamp 50 passes through the grooves 424*a*, 424*b* (see FIG. 3).

Figure 4:
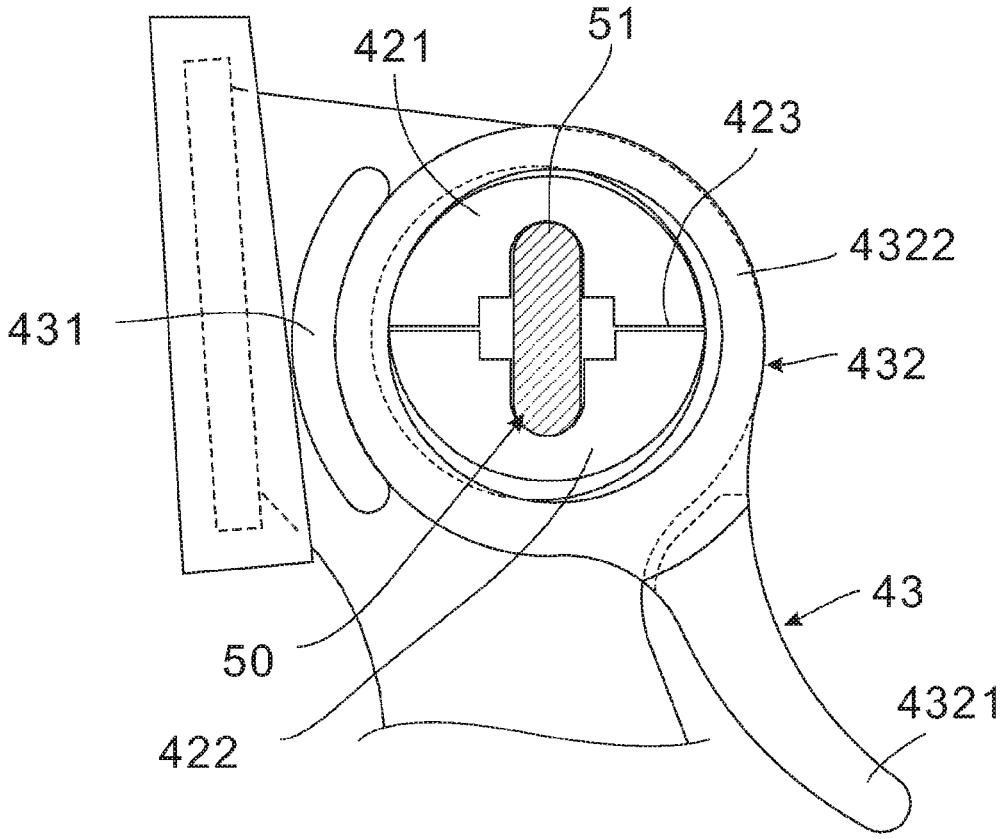
FIG. 4 is a view similar to FIG. 3 with the lever being clockwise pivoted about 135-degree to fasten the slide bar.

Further, a person may pivot the lever 4321 clockwise from the position shown in FIG. 3 to the position shown in FIG. 4 (i.e., a pivot angle of about 135-degree). After the pivoting, the wide portions of the cam rings 4322 lockingly engage with the arc members 431 with the first member 421 and the second member 422 drawn toward each other by the inward pushing force of the cam rings 4322. Thus, the width of the gap 423 is decreased to a minimum. As a result, the slide bar 51 is fastened by the first and second members 421, 422 (see FIGS. 4 and 5). Therefore, the person may push the jaws of another bar clamp 50 to clamp a workpiece (not shown) disposed therebetween prior to working.

To the contrary, an operation of the lever 4321 reversing above can loosen the slide bar 51. In another configuration (see FIG. 6), the fastening device 40 can be disposed on an end of an extension 312 opposite to the fixed jaw carrier 312.

Referring to FIGS. 7 to 11, a bar clamp in accordance with a second preferred embodiment of the invention is shown. The characteristics of the second preferred embodiment are substantially the same as that of the first preferred embodiment except the fastening device 40*a* as detailed below.

The fastening device 40*a* is mounted at a portion of an extending fixed jaw carrier 31*a* of a housing member 30. The fixed jaw carrier 31*a* is implemented as either a first fixed jaw carrier 311*a* in one configuration (see FIG. 7) or a first fixed jaw carrier 311*a* and an extension 312*a* opposing the first fixed jaw carrier 311*a* in the other configuration (see FIG. 11). The fastening device 40*a* comprises an externally threaded extension 45 on the fixed jaw carrier 31 adjacent the second jaw 32; a truncated conic through hole 44 through the externally threaded extension 45; a truncated conic urging assembly 42*a* movably disposed in the through hole 44 and including a first member 425 having a lengthwise groove 424*a*, a second member 426 having a lengthwise groove 424*b*, the second member 426 being a mirror of the first member 425, and a gap 423*a* defined between the first member 425 and the second member 426; and a fastening member 46 including an internally threaded hole 461, an inwardly extending rim 462 on the mouth of the internally threaded hole 461, and a lever 463. The internally threaded hole 461 is threadedly secured to the externally threaded extension 45. The rim 462 has an inner diameter less than an outer diameter of the truncated conic urging assembly 42*a* so that the truncated conic urging assembly 42*a* is prevented from disengaging from the through hole 44.

Figure 9:
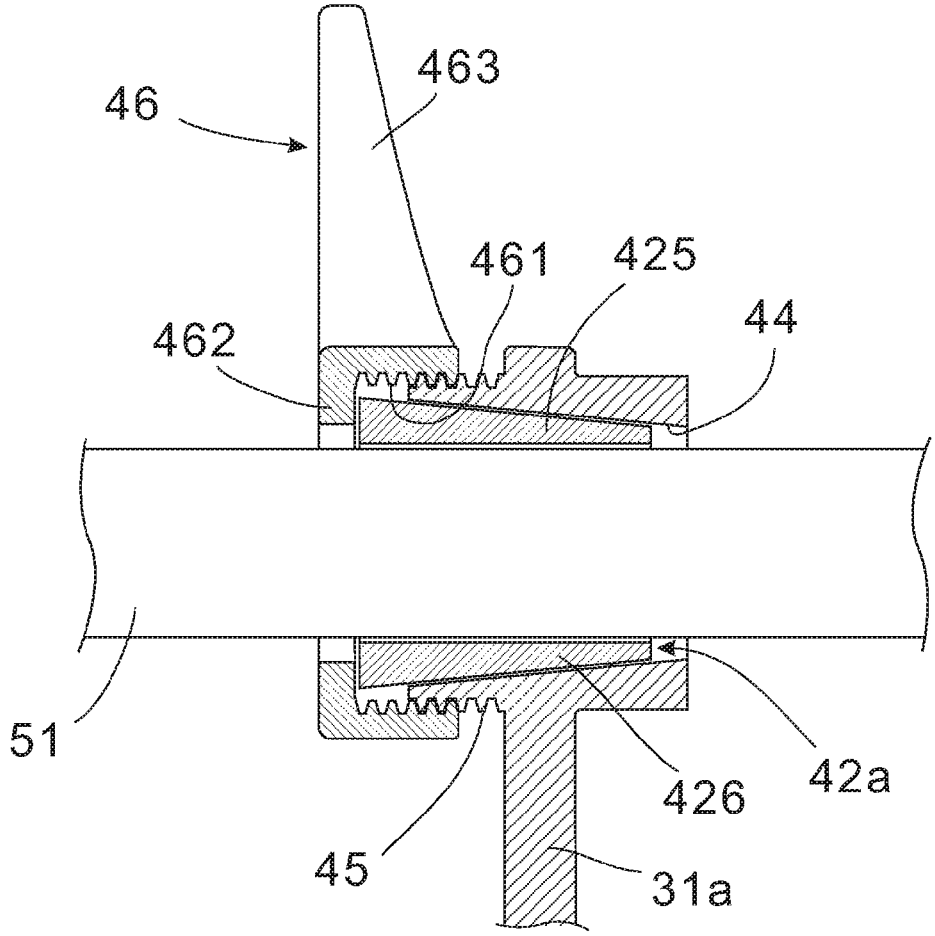
FIG. 9 is a view similar to FIG. 8 showing a slide bar of another bar clamp loosely passing through the urging assembly.

In an inoperative position (see FIGS. 7, 8 and 9), the lever 463 is substantially aligned with the fixed jaw carrier 31*a*. As shown in FIG. 9, another bar clamp having its slide bar 51 passing through the urging assembly 42*a* of one bar clamp. In detail, the loose slide bar 51 passes through the grooves 424*a*, 424*b*.

Figure 10:
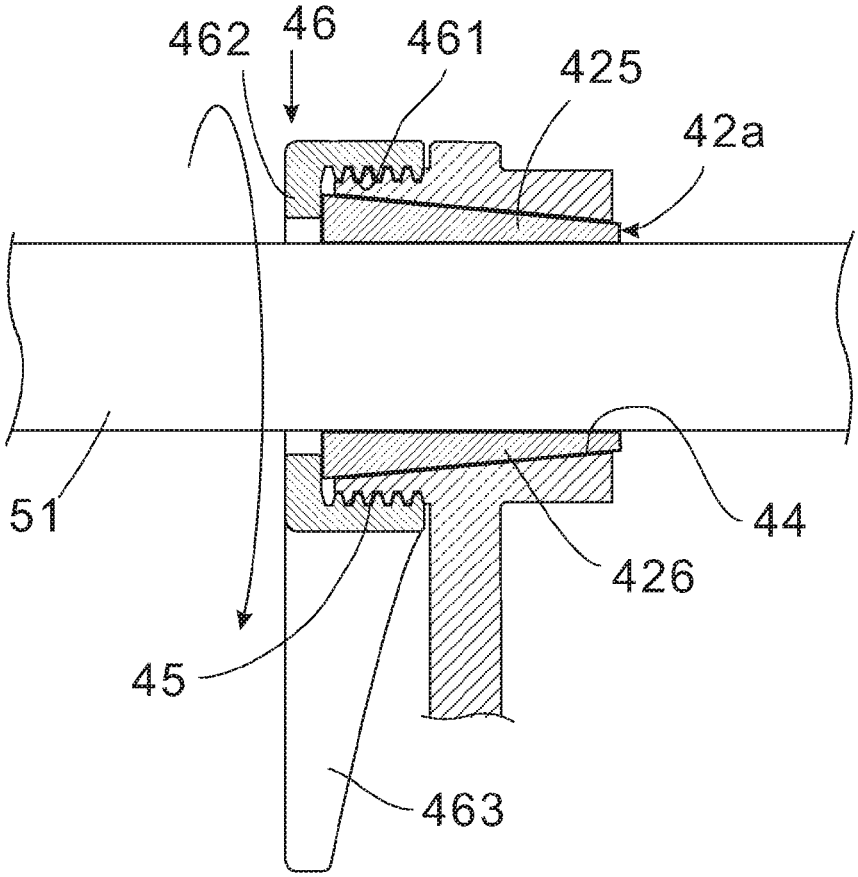
FIG. 10 is a view similar to FIG. 9 showing the lever being clockwise pivoted to cause the urging assembly to fasten the slide bar.
Figure 11:
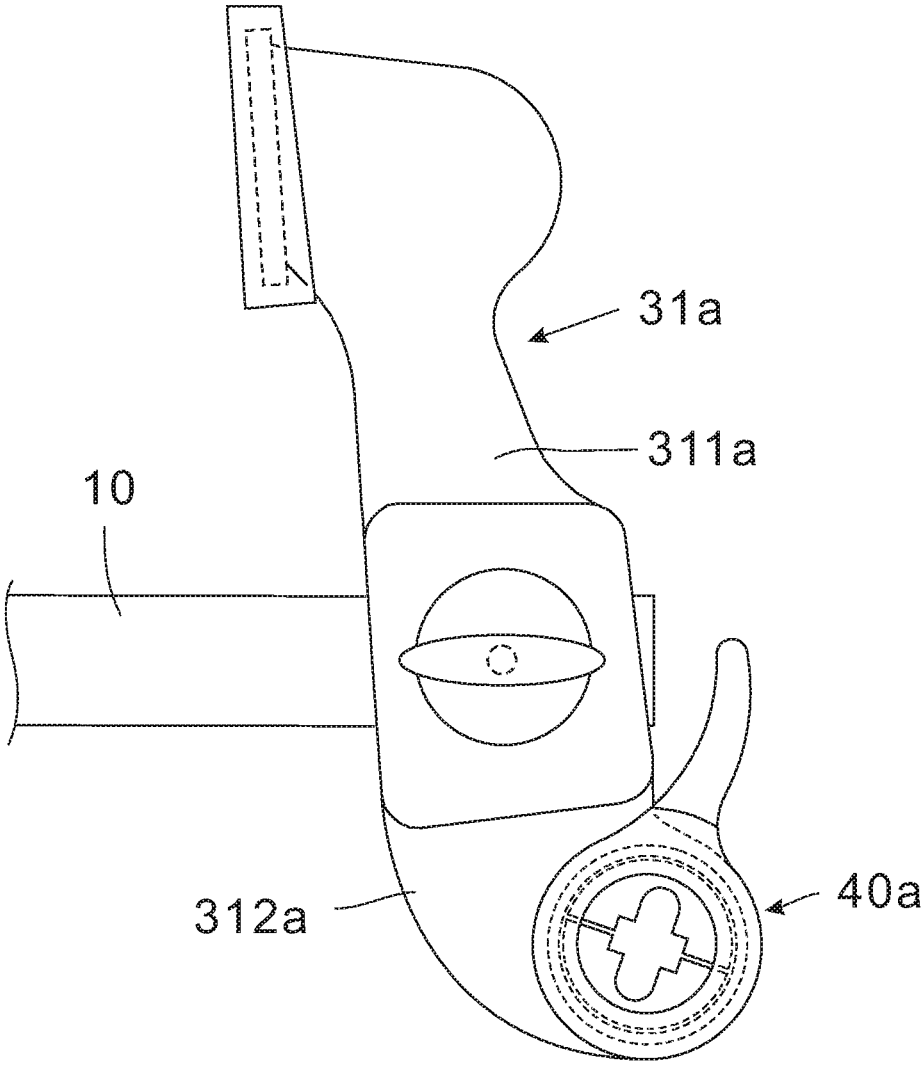
FIG. 11 is a view similar to FIG. 7 but showing another configuration of the fastening device which is disposed on an end of an extension opposite to the first fixed jaw carrier.

Further, a person may pivot the lever 463 clockwise from the position shown in FIG. 9 to the position shown in FIG. 10 by driving the internally threaded hole 461 along the externally threaded extension 45 in a direction of decreasing the distance between the fastening member 46 and the fixed jaw carrier 31*a*. And in turn, the urging assembly 42*a* is pushed further inward the through hole 44 by the rim 462 until the fastening member 46 is stopped by the fixed jaw carrier 31*a*. The inward moving urging assembly 42*a* may decrease the gap 423*a* to a minimum. As a result, the slide bar 51 is fastened by the first and second members 425, 426 (see FIG. 10). Therefore, the person may use the clamps to work on a workpiece (not shown).

To the contrary, an operation of the lever 463 reversing above can loosen the slide bar 51. In another configuration, the fastening device 40 can be disposed on an end of an extension 312*a* opposite to the first fixed jaw carrier 311*a*.

While the invention has been described in terms of preferred embodiments, those skilled in the art will recognize that the invention can be practiced with modifications within the spirit and scope of the appended claims.

What is claimed is:

1. A bar clamp comprising:

a slide bar;

a movable housing slidably mounted on the slide bar and comprising a movable jaw carrier including a first jaw at one end, a handgrip extending opposite to the movable jaw carrier, and a trigger handle pivotably disposed in the movable housing;

a housing member releasably mounted on a forward end of the slide bar and comprising a fixed jaw carrier and a second jaw at one end of the fixed jaw carrier; and a fastening device comprising a through hole formed through the fixed jaw carrier; a cylindrical urging assembly disposed through the through hole and including a first member having a lengthwise first groove, and a second member having a lengthwise second groove, the second member being a mirror of the first member and spaced from the first member by a gap; and a cam assembly including two arc members wherein one arc member is formed besides one end of the through hole and the other arc member is formed between the other end of the through hole, and a cam member including two spaced, opposite cam rings each having a first portion and a second portion opposing the first portion and larger than the first portion, and a lever formed with the cam rings, wherein each cam ring has an eccentric outer surface, the cam member is put on projecting portions of the first and second members with the cam rings being pivotably contacted the arc members, in an inoperative position the first portions of the cam rings are lockingly engaged with the arc members to allow a slide bar of another bar clamp to freely pass through the first and second grooves, and a clockwise pivotal movement of the lever from the inoperative position lockingly engages the second portions of the cam rings with the arc members by drawing the first member toward the second member, thereby fastening the slide bar of another bar clamp.

2. A bar clamp comprising:

a slide bar;

a movable housing slidably mounted on the slide bar and comprising a movable jaw carrier including a first jaw at one end, a handgrip extending opposite to the movable jaw carrier, and a trigger handle pivotably disposed in the movable housing;

a housing member releasably mounted on a forward end of the slide bar and comprising a fixed jaw carrier and a second jaw at one end of the fixed jaw carrier; and a fastening device comprising an externally threaded extension formed on the fixed jaw carrier; a truncated conic through hole formed through the externally threaded extension; a truncated conic urging assembly movably disposed in the through hole and including a first member having a lengthwise first groove, and a second member having a lengthwise second groove, the second member being a mirror of the first member and spaced from the first member by a gap; and a fastening member including an internally threaded hole threadedly secured to the externally threaded extension, a lever, and an inwardly extending rim on one end of the internally threaded hole, the inwardly extending rim having an inner diameter less than an outer diameter of the truncated conic urging assembly so that the truncated conic urging assembly is prevented from disengaging from the truncated conic through hole, wherein in an inoperative position a slide bar of another bar clamp is allowed to freely pass through the first and second grooves; and wherein a clockwise rotation of the lever from the inoperative position drives the internally threaded hole to push the truncated conic urging assembly further into the truncated conic through hole by the inwardly extending rim, thereby drawing the first member toward the second member to fasten the slide bar of another bar clamp.

* * * * *